US008461750B2

(12) United States Patent
Tozzi

(10) Patent No.: US 8,461,750 B2
(45) Date of Patent: Jun. 11, 2013

(54) PRE-CHAMBER SPARK PLUG AND ELECTRODES THEREFOR

(75) Inventor: Luigi P. Tozzi, Fort Collins, CO (US)

(73) Assignee: Woodward, Inc., Fort Collins, CO (US)

( * ) Notice: Subject to any disclaimer, the term of this patent is extended or adjusted under 35 U.S.C. 154(b) by 12 days.

(21) Appl. No.: 12/878,820

(22) Filed: Sep. 9, 2010

(65) Prior Publication Data

US 2011/0062850 A1 Mar. 17, 2011

Related U.S. Application Data

(60) Provisional application No. 61/241,583, filed on Sep. 11, 2009.

(51) Int. Cl.
*H01T 13/20* (2006.01)

(52) U.S. Cl.
USPC ..... 313/141

(58) Field of Classification Search
USPC ..... 313/118–145, 169 EL, 32, 41, 310; 123/143 R, 146.5 R, 169 R, 169 EL, 169 P, 123/260, 280
See application file for complete search history.

(56) References Cited

U.S. PATENT DOCUMENTS

| | | | | |
|---|---|---|---|---|
| 1,596,240 | A | | 9/1924 | Dikeman |
| 1,538,750 | A | | 5/1925 | Scognamillo |
| 2,047,575 | A | | 7/1936 | Burtnett |
| 2,208,030 | A | | 7/1940 | Holmes |
| 2,776,394 | A | | 2/1953 | Cuny et al. |
| 2,843,780 | A | | 7/1958 | Harper, Jr. |
| 3,718,425 | A | | 2/1973 | Weyl et al. |
| 3,958,144 | A | * | 5/1976 | Franks ..... 313/138 |
| 4,416,228 | A | | 11/1983 | Benedikt et al. |
| 4,771,209 | A | * | 9/1988 | Ryan ..... 313/140 |
| 4,795,937 | A | | 1/1989 | Wagner et al. |
| 4,901,688 | A | | 2/1990 | Kashiwara et al. |
| 4,930,473 | A | | 6/1990 | Dietrich |
| 4,963,784 | A | | 10/1990 | Niessner |
| 4,987,868 | A | | 1/1991 | Richardson |
| 5,014,656 | A | | 5/1991 | Leptich et al. |
| 5,051,651 | A | | 9/1991 | Kashiwara et al. |
| 5,369,328 | A | * | 11/1994 | Gruber et al. ..... 313/141 |
| 5,421,300 | A | | 6/1995 | Durling et al. |
| 5,430,346 | A | | 7/1995 | Johnson |

(Continued)

FOREIGN PATENT DOCUMENTS

| | | |
|---|---|---|
| CA | 1010329 | 5/1977 |
| CA | 2320415 A1 | 3/2001 |

(Continued)

OTHER PUBLICATIONS

U.S. Appl. No. 12/878,868, filed Sep. 9, 2010, Burke.

(Continued)

*Primary Examiner* — Donald Raleigh
(74) *Attorney, Agent, or Firm* — Reinhart Boerner Van Deuren P.C.

(57) ABSTRACT

An electrode for a spark plug includes a contact portion. In a particular embodiment, the electrode further includes an annular base and a support portion formed from a different material than the contact portion. The contact portion may be aligned axially with a central axis of the annular base. Further, the contact portion is configured to shield the annular base and the support portion from a second electrode inserted into the annular base.

22 Claims, 2 Drawing Sheets

U.S. PATENT DOCUMENTS

| | | | | |
|---|---|---|---|---|
| 5,554,908 | A | 9/1996 | Kuhnert et al. | |
| 5,555,862 | A | 9/1996 | Tozzi | |
| 5,574,329 | A * | 11/1996 | Kagawa | 313/141 |
| 5,619,959 | A | 4/1997 | Tozzi | |
| 5,623,179 | A | 4/1997 | Buhl | |
| 5,821,675 | A | 10/1998 | Suzuki | |
| 5,892,319 | A * | 4/1999 | Rossi | 313/141 |
| 5,947,076 | A | 9/1999 | Srinivasan et al. | |
| 6,013,973 | A | 1/2000 | Sato | |
| 6,060,822 | A | 5/2000 | Krupa et al. | |
| 6,064,144 | A | 5/2000 | Knoll et al. | |
| 6,130,498 | A | 10/2000 | Shimizu et al. | |
| 6,198,209 | B1 | 3/2001 | Baldwin et al. | |
| 6,326,719 | B1 | 12/2001 | Boehler et al. | |
| 6,460,506 | B1 | 10/2002 | Nevinger | |
| 6,611,083 | B2 | 8/2003 | LaBarge et al. | |
| 6,670,740 | B2 | 12/2003 | Landon, Jr. | |
| 7,104,245 | B2 | 9/2006 | Robinet et al. | |
| 7,615,914 | B2 | 11/2009 | Francesconi et al. | |
| 7,659,655 | B2 | 2/2010 | Tozzi et al. | |
| 2002/0094743 | A1 | 7/2002 | Harada | |
| 2002/0180326 | A1 | 12/2002 | Francesconi et al. | |
| 2004/0061421 | A1 * | 4/2004 | Morita et al. | 313/142 |
| 2004/0100179 | A1 | 5/2004 | Boley et al. | |
| 2005/0211217 | A1 | 9/2005 | Boley et al. | |
| 2006/0022565 | A1 | 2/2006 | Landon | |
| 2007/0236122 | A1 | 10/2007 | Borror | |
| 2007/0290593 | A1 | 12/2007 | Kowalski | |
| 2009/0107440 | A1 * | 4/2009 | Lykowski et al. | 123/169 EL |

FOREIGN PATENT DOCUMENTS

| | | | |
|---|---|---|---|
| CN | 2825995 | Y | 10/2006 |
| DE | 101 44 976 | A1 | 4/2003 |
| EP | 0 675 272 | A1 | 10/1995 |
| EP | 1441427 | A1 | 7/2004 |
| EP | 1976081 | A2 | 1/2008 |
| EP | 1556932 | B1 | 7/2008 |
| EP | 1950856 | A1 | 7/2008 |
| EP | 1965475 | A1 | 9/2008 |
| FR | 764079 | A | 5/1934 |
| FR | 985788 | A | 7/1951 |
| FR | 2071129 | A5 | 9/1971 |
| FR | 2131938 | B2 | 8/1978 |
| JP | 50077738 | A | 6/1975 |
| JP | 57-018283 | | 1/1982 |
| JP | 58-162719 | | 9/1983 |
| JP | H02148588 | U | 12/1990 |
| JP | 4133281 | | 5/1992 |
| JP | 4262388 | A | 9/1992 |
| WO | WO 92/02718 | A1 | 2/1992 |
| WO | WO 2004/107518 | A1 | 12/2004 |

OTHER PUBLICATIONS

Maria-Emmanuella McCoole, M.Sc.E.E. et al.; Solutions for Improving Spark Plug Life in High Efficiency, High Power Density, Natural Gas Engines; Proceedings of ICES2006; ASME Internal Combustion Engine Division 2006 Spring Technical Conference; May 8-10, 2006, Aachen, Germany; ICES2006-1417; pp. 1-8.

Dr. Luigi Tozzi et al.; Advanced Combustion System Solutions for Increasing Thermal Efficiency in Natural Gas Engines While Meeting Future Demand for Low NOx Emissions; Proceedings of JRCICE2007; 2007 ASME/IEEE Joint Rail Conference & Internal Combustion Engine Spring Technical Conference; Mar. 13-16, 2006, Pueblo, Colorado USA; JRCICE2007-40026; pp. 1-7.

Jessica Adair et al.; Knock Characterization Using Ionization Detection; GMRC Gas Machinery Conference; Oklahoma City, Oklahoma; Oct. 2006; pp. 1-23.

Hironori Osamura, Development of Long Life and High Ignitability iridium Spark Plug, Technical Paper, Seoul 2000 FISITA World Automotive Congress; Jun. 12-15, 2000 Seoul, Korea; 6 pages.

Hironori Osamura, Development of New Iridium Alloy for Spark Plug Electrodes; SAE Technical Paper Series; 1999-01-0796; SI Engine Components and Technology (SP-1437); International Congress and Exposition Mar. 1-4, 1999; 14 pages.

* cited by examiner

PRE-CHAMBER SPARK PLUG AND ELECTRODES THEREFOR

CROSS-REFERENCE TO RELATED PATENT APPLICATIONS

This patent application claims the benefit of U.S. Provisional Patent Application No. 61/241,583, filed Sep. 11, 2009, the entire teachings and disclosure of which are incorporated herein by reference thereto.

FIELD OF THE INVENTION

This invention relates generally to pre-chamber spark plugs, and more particularly to electrodes for use therewith.

BACKGROUND OF THE INVENTION

Engines operating on gaseous fuels, such as natural gas, are commonly supplied with a lean fuel mixture, which is a mixture of air and fuel containing a relatively high ratio of air to fuel. The lean fuel mixture often results in misfires, detonation, incomplete combustion and poor fuel economy. One factor that can lead to such events is the poor ability of conventional spark plugs to effectively ignite a lean fuel mixture in the cylinder of the operating engine. More effective combustion of lean fuel mixtures can be achieved using a pre-combustion chamber.

Pre-chamber (i.e., pre-combustion chamber) spark plugs are typically used to enhance the flammability limits in engines such as natural gas burn engines. As in any spark plug, the pre-chamber spark plugs typically include a pair of electrodes including a ground electrode and a charged electrode. The ground electrode is annular shaped with the a plurality of radially inward projecting tips that surround the charged electrode. Consequently, the charged electrode generally extends axially into the charged electrode generally along a central axis defined by the annular ground electrode.

To extend spark plug life, the tips generally include a precious metal (PM) material secured to a base material. While such inclusion extends the life of the spark plug, spark initiation and maintenance can be an issue. Specifically, it has been determined by the applicant that the shape and configuration of the base material to which the PM material is mounted relative to the shape of the PM material can affect the spark initiation and maintenance between the ground and charged electrode. That is, when a non-homogeneous sparking surface is present, sparks can occur randomly in various locations which results in a large coefficient of variation in indicated mean effective pressure (C0V IMEP). This non-homogeneous sparking surface can also be generated by the shape of the base material (i.e. lobes or spokes) to which the PM material is mounted. If the base material is exposed to or close enough to the charged electrode, the surface of the base material forms part of the sparking surface generating a non-homogenous sparking surface.

As such, there is a need in the art for a pre-chamber spark plug that has extended life enabled by the inclusion of PM material, but that does not suffer from spark initiation and maintenance issues resulting from non-homogenous sparking surfaces present in the art. Embodiments of the present invention provides such improvements in pre-chamber spark plugs and particularly ground electrodes for pre-chamber spark plugs.

BRIEF SUMMARY OF THE INVENTION

In view of the above, embodiments of the present invention provide a new and improved spark plug that overcomes one or more of the above problems existing in the art. More particularly, embodiments of the present invention provide a new and improved pre-chamber spark plug. Still more particularly, embodiments of the present invention provide new and improved electrodes for use in a pre-chamber spark plug.

In one embodiment, the electrode includes an annular base portion, a support portion and a contact portion. The support portion extends radially inward from the base portion. The support portion is formed of a first material. The contact portion is attached to the support portion such that the support portion is radially interposed between the contact portion and the annular base portion. The contact portion is formed of a second material different than the first. The support portion is configured such that it is shielded from a central axis of the annular base by the contact portion. This shielding prevents a non-homogeneous spark surface (i.e. a spark surface formed by both the contact portion as well as either or both of the annular base or the support portions.

To further promote shielding, in one embodiment the contact portion has a dimension that is greater than a corresponding dimension of the support portion such that an undercut is formed between the contact portion and at least one of the support portion and the annular base portion. In a preferred implementation, the contact portion has a generally crescent shaped cross-section that receives a radially inner distal end of the support portion radially therein. In some embodiments, the distal end of the support portion is generally flat and the crescent shape of the contact portion defines a groove that has a generally flat bottom wall that mates with the flat distal end of the support portion. Alternatively, the distal end of the support portion is curved and the crescent shape of the contact portion defines a groove that has a corresponding curved shape that mates with the curved distal end of the support portion. In this embodiment, it is preferred that the thickness of the contact portion is substantially uniform. This crescent shape provides improved utilization of the second material to reduce the cost of the second material included in the electrode.

Further, to promote the shielding effect and the formation of an undercut region, the distal ends of the crescent shape of the contact portion preferably overlap generally radially extending sides of the support portion in one embodiment.

In other embodiments, the contact portion is generally circular in cross-section and a distal end of the support portion is concave to mate with the circular cross-section of the contact portion. Alternatively, the distal end portion could be flat and the contact portion could be rectangular or even polygonal in shape.

In other embodiments of the invention, a spark plug including first and second electrodes is provided. The first electrode could be any of the preceding electrodes. The second electrode will be axially received within the electrode receiving aperture of the annular base portion of the first electrode.

Preferably, a first surface of the contact portion that faces a second surface of the second electrode and the second surface of the second electrode are divergent in at least one plane. This causes a narrowed gap to be formed between the two electrodes. The divergence of the first and second surfaces is provided by at least one curved surface such that a distance between the surfaces first decreases and then increases when traveling along a direction perpendicular to the distance.

Preferably, the contact portion in the spark plug or the electrode is provided by an Iridium alloy while the base material to which the contact portion is mounted is provided by a Nickel alloy. However other materials are contemplated.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
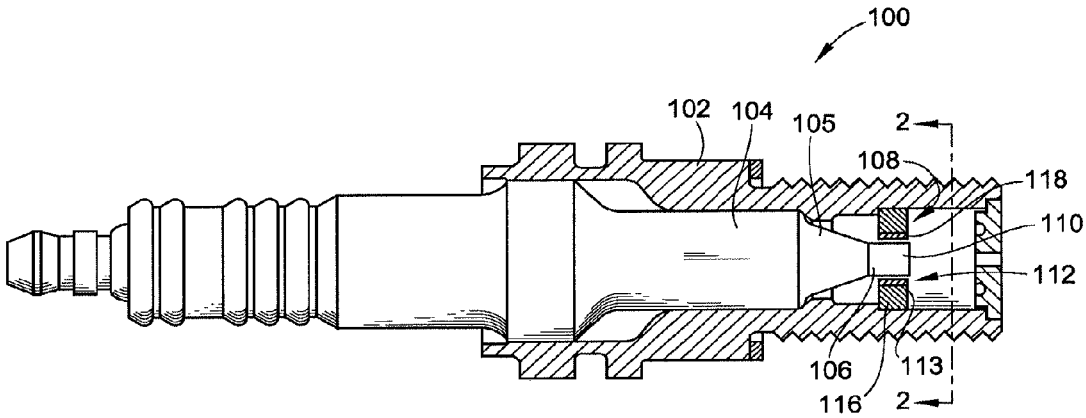
FIG. 1 is a cross-sectional illustration of a spark plug according to an embodiment of the present invention.
Figure 2:
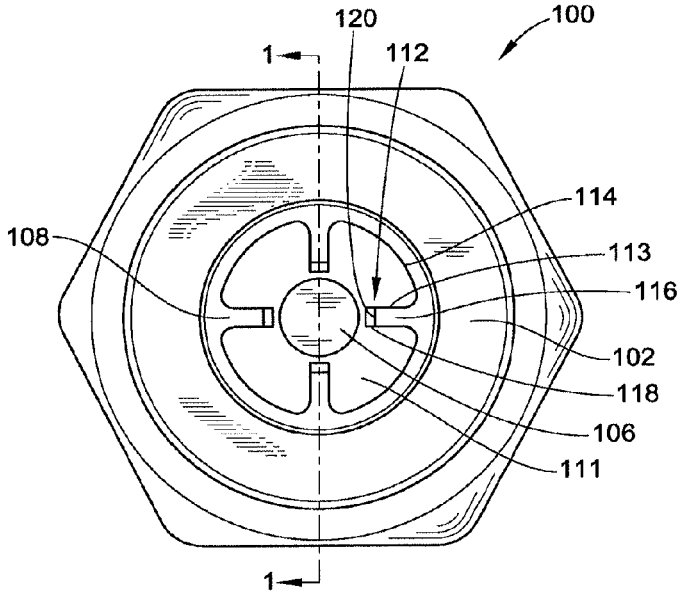
FIG. 2 is a simplified end-view illustration of the spark plug of FIG. 1.

FIG. 1 is a partial cross-sectional illustration and FIG. 2 is an end view illustration of a pre-chamber spark plug 100 (also referred to as "spark plug 100") according to an embodiment of the present invention. Pre-chamber spark plugs, and particularly spark plugs in general, are known in the art, so a detailed description of the conventional portions of the pre-chamber spark plug 100 need not be described in detail herein.

The spark plug 100 includes a cylindrical shell 102 and an insulator 104 that is fitted into the shell 102. The shell 102 is typically formed from metallic material such as low-carbon steel. A center electrode 106 (also referred to as a charged electrode) is disposed inside the insulator 104 such that a portion at a tip portion 105 projects from the insulator 104.

In a conventional spark plug, a ground electrode is used wherein one end is joined to the shell through, for example, welding and whose opposite end is bent laterally such that a side face thereof faces a tip portion of the center electrode. Unlike a conventional spark plug, the ground electrode 108 of the present invention is generally annular or otherwise disc-like and is mounted proximate the end 110 of the center electrode 106. A spark gap 112 is formed between the ground electrode 108 and the center electrode 106. The center electrode 106 extends through the aperture 111 defined by the ground electrode 108 such that the center electrode 106 is surrounded by ground electrode 108.

The ground electrode 108 includes a plurality of tips 113 that define spark gaps 112. The spark that is generated between the ground electrode 108 and center electrode 106 is initiated between tips 113 and center electrode 106 within spark gap 112. In the illustrated embodiment, the ground electrode 108 generally includes an annular base portion 114 from which the tips 113 extend radially inward. Each tip 113 includes a support portion 116 that supports a contact portion 118. The support portion 116 is typically formed as a one-piece construction with base portion 114. To be a one-piece construction, the structure must be a continuous structure not formed from a plurality of separate components secured together. Thus, for example, the one-piece construction could be formed by machining from a single blank of material or a one-step molding process or alternatively from a continuous extruding process.

The ground electrode 108 is typically secured, such as by welding or brazing, to the outer shell 102.

To improve spark generation, the contact portions 118 are formed from a different metal material than the base or support portions 114, 116. Typically, the base and support portions 114, 116 are formed from a non-precious metal such as Nickel-200. The contact portion 118 is preferably formed from a precious metal (PM) material such as an Iridium alloy rod. Other precious metal materials include alloys made from metals that are in the noble metal family, including but not limited to: Platinum, Rhodium, Gold, Iridium, Osmium, Palladium, Rhenium, Ruthenium, Silver, etc. or other metals that are corrosion resistant and have good conductivity. Further, while FIG. 2 illustrates a rectangular PM contact portion 118, other shaped contact portions 118 can be used in other embodiments. For instance, a contact portion 118 could have cross-sectional profiles that are triangular, rectangular, polygonal, hemispherical (½ round), oblong, elliptical, crescent shaped, bezel strip, tubing, low dome, helical, etc. and the present invention is not limited to any particular shape.

Individual pieces or pins of PM material contact portions 118 may be welded to the support portions 116 after the base and support portions 114, 116 have been machined to final form. This requires fixturing the contact portions 118 to the distal ends 120 of the support portions 116 and then laser welding the contact portions 118 thereto. Alternatively, the PM contact portions 118 and the base or support portions 114, 116 may be formed using the method of co-pending application Ser. No. 12/878,868, entitled Method of Forming an Electrode for a Spark Plug, filed on even date herewith, and assigned to the assignee of the instant application, the teachings and disclosure of which are incorporated in their entireties by reference thereto.

It has also been determined that there are several design aspects of the ground electrode that promote improve spark initiation, reduce random spark initiation as well as to prevent spark erosion. A further benefit of the new designs is to prevent the random spark generation which resulted in large coefficient of variation in indicated mean effective pressure (C0V IMEP).

Figure 3:
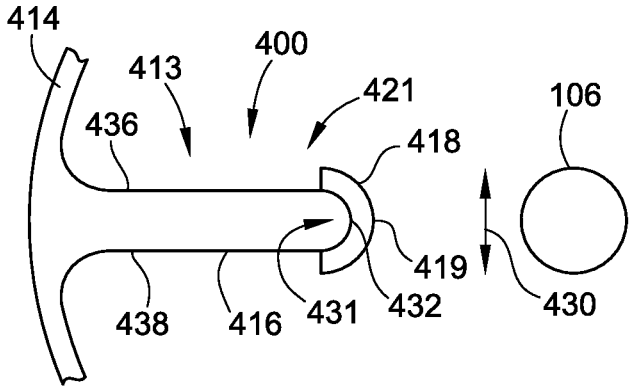
FIG. 3-5 are partial illustrations of alternative embodiments of electrodes according to the present invention.
Figure 4:
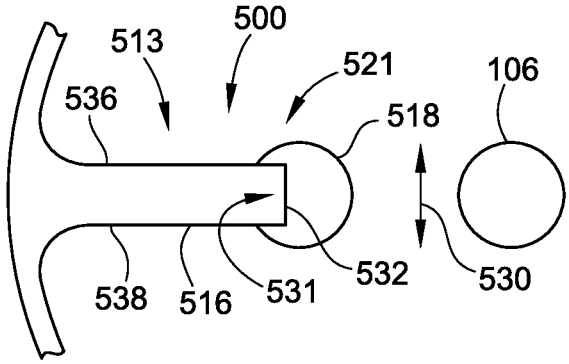
Figure 5:
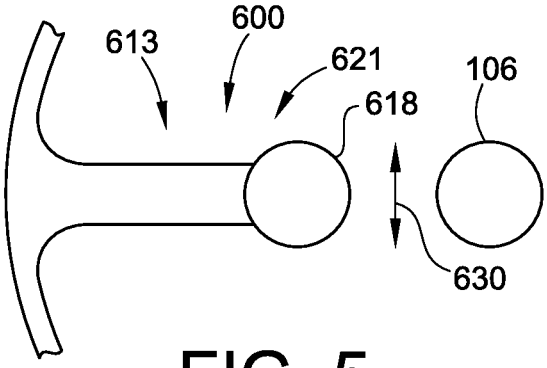

FIGS. 3-5 illustrate a further feature of preferred embodiments of ground electrodes 400, 500 and 600 according to the present invention. FIGS. 3-5 are partial illustrations of a single tip portion 413, 513, 613 of ground electrodes 400, 500, 600.

With primary reference to FIG. 3, it is desired to have a homogeneous sparking surface 419 formed by a single material and preferably from the PM material. This sparking surface is thus provided entirely by contact portion 418. In other words it has been determined that is desirable to prevent the sparking surface to include any of the base material (i.e. non-PM material) of the support portions 416.

Therefore, tip portion 413 includes an undercut region 421 positioned axially between contact portion 418 and base portion 414. This undercut region 421 further spaces the non-PM material of the support portion 416 further away from a corresponding charged or center electrode of the finished pre-chamber spark plug. Also, this undercut region 421 allows the geometry of the contact portion 418 to shield the base material of the support portion 416 from the center electrode so as to prevent spark generation between the support portion 416 and a corresponding center electrode. While the support portion 416 of the illustrated embodiment has generally parallel side portions 436, 438 that defines a width that is smaller than a parallel width of the contact portion. The side portions 436, 438 could be tapered such that a base of the support portion 416, i.e. the portion proximate annular base portion 414, is wider than a distal end portion 432 of the support portion. Further the base of the support portion 416 could even be wider than the contact portion 418. However, its radial distance from the charged electrode 106 would provide the desired shielding.

Therefore, only the contact portion 418 will generate the spark as the non-PM material is shielded and/or too far away from the center electrode to generate the spark. As the contact portion 418 is of a homogeneous composition, random spark initiation is prevented. A single material is used to generate the spark between the charged electrode and the ground electrode.

The undercut region 421 need not be provided if the support portions and the contact portions are configured to keep the support portions from forming any portion of the spark surface such that a substantially homogenous spark surface is provided, e.g. provided only by the contact portions.

A further feature of these new and improved ground electrodes is also illustrated in FIG. 1. More particularly, the contact portion 118 of the ground electrodes are oriented axially. In other words, the length of the contact portion 118 is generally parallel with charged electrode 106.

Further yet, the faces of the contact portion 418, 518, 618 and the face of the charged electrode 106 are generally configured in a divergent manner. This arrangement promotes arc-root movement and spark growth during spark discharge. These faces are considered to be divergent because the gap between the faces generally increases when moving in a direction perpendicular to the distance therebetween, such as along arrows 430, 530, 630. This divergent arrangement is also provided in the embodiment illustrated in FIG. 2.

Further, FIGS. 3-5 illustrate alternative mating arrangements between the support portions 416 516, 616 and contact portions 418, 518, 618. The embodiment of FIG. 3 has the best utilization of the PM material. Further, there is uniform thickness of the PM material creating improved spark propagation. However, all of these designs provide the improved arrangement of providing the desired undercuts 421, 521, 621.

Both embodiments of FIGS. 3 and 4 can be considered to have a contact portion 418, 518 that is considered to be crescent shaped having distal end portions. The crescent shape of the contact portions 418, 518 defines a channel 431, 531 that receives the distal end portion 432, 532 of support portions 416, 516. The bottom of the channels 431, 531 is shaped and configured to mate with distal ends 432, 532. Thus, distal end 432 has an arcuate or curved shape that corresponds to the arcuate or curved shape of the bottom of channel 431. Similarly, distal end 532 is flat and contact groove 531 has a corresponding flat bottom.

In some embodiments, the crescent shape could be formed by half of a tube. In other words, a tubular rod of the PM material could be cut along its axial length and perpendicular to its tubular cross-section. The equivalent shape could be formed directly from an extrusion or molding process and need not actually be formed from a tubular rod. Further, embodiments need not include a full 180 degrees of a tubular cross-section (i.e. half) but could be less than 180 degrees. Further, depending on the desired radial curvature of the sparking surface, the cross-section need not have a constant radius of curvature.

This curved shape or generally crescent shape for the contact portions allows the minimum amount of PM material to be used but to still provide a homogenous contact portion or sparking surface, i.e. a contact portion or sparking surface provided by a single material. This is opposed to the shape provided for example in FIG. 5.

The end portions of the crescent shape of end portions 418, 518 generally overlap the radially extending sides 436, 438; 536, 538 of the support portions 416, 516. This arrangement is such that the contact portions 418, 518 have a dimension that is greater than the support portions 416, 516 to facilitate generation of the undercut regions 413, 513 and to promote shielding.

Although not illustrated, in embodiments that utilize brazing, there will typically also be a layer of brazing material radially interposed between the contact portions and the support portions.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An electrode arrangement for a spark plug comprising:

a center electrode having a first smooth sparking surface over its entire periphery; and a ground electrode surrounding the center electrode, the ground electrode having:

an annular base portion;

a support portion extending radially inward from the base portion, the support portion being formed of a first material;

a contact portion having a second smooth sparking surface over its entire periphery, the contact portion attached to the support portion such that the support portion is radially interposed between the contact portion and the annular base portion, the contact portion being formed of a second material;

wherein the support portion is configured such that it is shielded from a central axis of the annular base by the contact portion; and wherein the contact portion has a generally crescent shaped cross-section that receives a radially inner distal end of the support portion radially therein.

2. The electrode claim 1, wherein the contact portion has a dimension that is greater than a corresponding dimension of the support portion such that an undercut is formed between the contact portion and at least one of the support portion and the annular base portion.

3. The electrode of claim 1, wherein the distal end of the support portion is generally flat and the crescent shape of the contact portion defines a groove that has a generally flat bottom wall that mates with the flat distal end of the support portion.

4. The electrode of claim 1, wherein the distal end of the support portion is curved and the crescent shape of the contact portion defines a groove that has a corresponding curved shape that mates with the curved distal end of the support portion.

5. An electrode for a spark plug comprising: an annular base portion;

a support portion extending radially inward from the base portion, the support portion being formed of a first material;

a contact portion attached to the support portion such that the support portion is radially interposed between the contact portion and the annular base portion, the contact portion being formed of a second material;

wherein the support portion is configured such that it is shielded from a central axis of the annular base by the contact portion;

wherein the contact portion has a generally crescent shaped cross-section that receives a radially inner distal end of the support portion radially therein; and wherein distal ends of the crescent shape of the contact portion overlap generally radially extending sides of the support portion.

6. An electrode arrangement for a spark plug comprising:

a center electrode having a first smooth sparking surface over its entire periphery; and a ground electrode surrounding the center electrode, the ground electrode having:

an annular base portion;

a support portion extending inward from the base portion, the support portion being formed of a first material;

a contact portion having a second smooth sparking surface over its entire periphery, the contact portion attached to the support portion such that the support portion is radially interposed between the contact portion and the annular base portion, the contact portion being formed of a second material;

wherein the support portion is configured such that is shielded from a central axis of the annular base by the contact portion; and wherein the contact portion is generally circular in cross-section and a distal end of the support portion is concave to mate with the circular cross-section of the contact portion.

7. The electrode of claim 6 wherein the contact portion is aligned axially relative to the annular base portion.

8. A spark plug comprising:

a first electrode including:

an annular base portion defining an electrode receiving aperture;

a support portion extending radially inward from the base portion, the support portion being formed of a first material;

a contact portion having a first smooth sparking surface over its entire periphery, the contact portion attached to the support portion such that the support portion is radially interposed between the contact portion and the annular base portion, the contact portion being formed of a second material; and wherein the support portion is configured such that it is shielded from a central axis of the annular base by the contact portion;

a second electrode extending axially within the electrode receiving aperture of the annular base portion of the first electrode, the second electrode having a second smooth sparking surface over its entire periphery; and wherein the contact portion has a generally crescent shaped cross-section that receives a radially inner distal end of the support portion radially therein.

9. The spark plug of claim 8, wherein the contact portion has a dimension that is greater than a corresponding dimension of the support portion such that an undercut is formed between the contact portion and at least one of the support portion and the annular base portion.

10. The spark plug of claim 8, wherein the distal end of the support portion is generally flat and the crescent shape of the contact portion defines a groove that has a generally flat bottom wall that mates with the flat distal end of the support portion.

11. The spark plug of claim 8, wherein the distal end of the support portion is curved and the crescent shape of the contact portion defines a groove that has a corresponding curved shape that mates with the curved distal end of the support portion.

12. The spark plug of claim 8, wherein the first electrode includes a plurality of support portions and a plurality of contact portions, a single contact portion attached to each of the support portions.

13. The spark plug of claim 8, wherein the contact portion is brazed to the support portion.

14. The spark plug of claim 13, wherein the second material is an Iridium alloy and the first material is a Nickel alloy.

15. A spark plug comprising:

a first electrode including:

an annular base portion defining an electrode receiving aperture;

a support portion extending radially inward from the base portion, the support portion being formed of a first material;

a contact portion attached to the support portion such that the support portion is radially interposed between the contact portion and the annular base portion, the contact portion being formed of a second material; and wherein the support portion is configured such that it is shielded from a central axis of the annular base by the contact portion;

a second electrode extending axially within the electrode receiving aperture of the annular base portion of the first electrode;

wherein the contact portion has a generally crescent shaped cross-section that receives a radially inner distal end of the support portion radially therein; and wherein distal ends of the crescent shape of the contact portion overlap generally radially extending sides of the support portion.

16. A spark plug comprising:

a first electrode including:

an annular base portion defining an electrode receiving aperture;

a support portion extending radially inward from the base portion, the support portion being formed of a first material;

a contact portion having a first smooth sparking surface over its entire periphery, the contact portion attached to the support portion such that the support portion is radially interposed between the contact portion and the annular base portion, the contact portion being formed of a second material; and wherein the support portion is configured such that it is shielded from a central axis of the annular base by the contact portion;

a second electrode extending axially within the electrode receiving aperture of the annular base portion of the first electrode, the second electrode having a second smooth sparking surface over its entire periphery; and wherein the contact portion is generally circular in cross-section and a distal end of the support portion is concave to mate with the circular cross-section of the contact portion.

17. The spark plug of claim 16, wherein the contact portion is aligned axially relative to the annular base portion.

18. A spark plug comprising:

a first electrode including:

an annular base portion defining an electrode receiving aperture;

a support portion extending radially inward from the base portion, the support portion being formed of a first material;

a contact portion having a first smooth sparking surface over its entire periphery, the contact portion attached to the support portion such that the support portion is radially interposed between the contact portion and the annular base portion, the contact portion being formed of a second material;

wherein the support portion is configured such that it is shielded from a central axis of the annular base by the contact portion;

a second electrode extending axially within the electrode receiving aperture of the annular base portion of the first electrode, the second electrode having a second smooth sparking surface over its entire periphery; and wherein a portion of a first surface of contact portion that faces a second surface of the second electrode and the second surface of the second electrode are divergent in at least one plane.

19. The spark plug of claim 18, wherein the divergence of the first and second surfaces is provided by first and second curved surfaces;

wherein a first point on the first curved surface and second point on the second curved surface are at a minimum distance between the first and second curved surfaces;

wherein movement along a curvature of the first curved surfaces away from the first point to a third point is such that the distance from the third point to a nearest point on the second curved surface is greater than the minimum distance; and wherein the distance from the third point to the nearest point on the second curved surface increases as the distance between the first point and third point increases.

20. A spark plug comprising:

a first electrode including:

a base portion having a generally annular cross-section defining an second electrode receiving aperture;

a support portion extending radially inward from the base portion, the support portion being formed of a first material;

a contact portion having a first smooth sparking surface, the contact portion attached to the support portion, the contact portion being formed of a second material;

second electrode extending axially through the second electrode receiving aperture, the second electrode having a second smooth sparking surface;

wherein the contact portion extends parallel to the second electrode; and wherein the contact portion has a first sparking face that faces the second electrode and the second electrode has a second sparking face that faces the contact portion, the first and second sparking faces being configured to define a single closest point therebetween.

21. The spark plug of claim 20, wherein the contact portion has a radial dimension that is less than an dimension extending parallel to the second electrode.

22. The spark plug claim 20, wherein the contact portion is formed from a precious metal.

* * * * *